US005469729A

United States Patent [19]

Hager

[11] Patent Number: 5,469,729

[45] Date of Patent: Nov. 28, 1995

[54] METHOD AND APPARATUS FOR PERFORMING MULTIPLE NECKING OPERATIONS ON A CONTAINER BODY

[75] Inventor: Milton S. Hager, Westminster, Colo.

[73] Assignee: Ball Corporation, Muncie, Ind.

[21] Appl. No.: 157,827

[22] Filed: Nov. 23, 1993

[51] Int. Cl.[6] ..... B21D 41/04

[52] U.S. Cl. ..... 72/379.4; 72/463; 413/69

[58] Field of Search ..... 72/352, 379.4, 72/463; 413/69

[56] References Cited

U.S. PATENT DOCUMENTS

| | | | |
|---|---|---|---|
| 388,288 | 8/1883 | Knapp . | |
| 2,305,803 | 12/1942 | Bayer | 72/463 |
| 2,781,016 | 2/1957 | Livermont | 72/463 |
| 2,821,156 | 1/1958 | Lyon | 113/49 |
| 2,901,995 | 9/1959 | Lavigne | 113/38 |
| 3,039,413 | 6/1962 | Rogers | 113/42 |
| 3,344,646 | 10/1967 | Moller | 72/348 |
| 3,687,098 | 8/1972 | Maytag | 113/120 |
| 3,786,957 | 1/1974 | Hilgenbrink | 220/83 |
| 4,157,693 | 5/1979 | Openchowski et al. | 113/120 |
| 4,361,020 | 11/1982 | Hirota et al. | 72/87 |
| 4,403,493 | 9/1983 | Atkinson | 72/356 |
| 4,513,595 | 4/1985 | Cvacho | 72/43 |
| 4,519,232 | 5/1985 | Traczyk et al. | 413/69 |
| 4,621,513 | 11/1986 | Bradford, Jr. | 72/334 |
| 5,016,463 | 5/1991 | Johansson et al. | 72/354.8 |

FOREIGN PATENT DOCUMENTS

| | | | |
|---|---|---|---|
| 9211740 | 7/1987 | European Pat. Off. . | |
| 2040200 | 8/1980 | United Kingdom | 72/379.4 |

*Primary Examiner*—Lowell A. Larson
*Attorney, Agent, or Firm*—Gilbert E. Alberding

[57] ABSTRACT

Method and apparatus for performing multiple necking operations, such as by utilizing a plurality of die necking stations. In one aspect of the present invention a plurality of venting port(s) are incorporated on a necking assembly which performs a necking operation on a necked container body. In another aspect of the present invention the container body is centered with respect to a necking assembly which produces a double-neck container body configuration.

21 Claims, 4 Drawing Sheets

METHOD AND APPARATUS FOR PERFORMING MULTIPLE NECKING OPERATIONS ON A CONTAINER BODY

FIELD OF THE INVENTION

The present invention generally relates to the field of forming container bodies and, more particularly, to performing multiple necking operations on the open end of a container body. The present invention is particularly applicable to multiple die necking operations.

BACKGROUND OF THE INVENTION

A significant amount of the development efforts in the container industry continues to be directed toward reducing material requirements and thus material costs in order to gain a competitive advantage. For instance, in the case of drawn and ironed ("D/I") containers the geometry/configuration of various portions of the container body have been modified in order to maintain/increase the strength of the container body to accommodate a reduction in the gauge of sheet metal from which the bodies are formed. Moreover, material requirements have been reduced for D/I containers by necking the open end of the container body to reduce its diameter and thus the diameter of the end piece required to seal the container body.

In order to further realize the benefits associated with necking, multiple necking operations have been implemented to reduce the diameter of the end piece to an even greater extent. However, performing multiple necking operations, particularly when using thinner gauges of sheet metal, may increase the potential for wrinkling and/or other types of metal deformation of the container body. Moreover, alignment problems in multiple necking operations may cause damage to the container body due, for instance, to an undesired impact between the container body and a necking die. In addition, misalignment of the container body with a necking die may also produce a necked portion which is not concentric with the container's sidewall. This may cause problems in subsequent container body processing, such as when seaming the end piece onto the necked portion and which may result in a defective seal. These types of defects often require that the container body be scrapped, thereby increasing material requirements.

In addition to the reduction of material requirements, significant development efforts have also been directed toward increasing the production rate of the overall container body forming process. Specifically with regard to die necking operations, production rates may be increased by increasing the speed at which the container body is axially advanced relative to the necking die. However, this increase in speed may cause a number of problems, particularly in multiple necking operations. For instance, after an initial necking operation portions of the container body are typically unsupported in one or more subsequent necking operations such that the potential for wrinkling and/or other metal deformation of these portions exists, due for instance to the increase in hydraulic-type pressures being exerted on such unsupported portions at the desired increased speeds. Moreover, the effects of any misalignment of the container body with the necking die may be magnified at increased production speeds. Consequently, increases in production speed may be accompanied by an increase in the number of container bodies which are scrapped.

Based upon the foregoing, it can be appreciated that it would be desirable to take advantage of the reduction in material requirements associated with multiple necking operations, particularly at increased production speeds, while reducing the number of defects introduced into container bodies when undergoing multiple necking operations and thus reducing material requirements.

SUMMARY OF THE INVENTION

The present invention is a method and apparatus for performing multiple necking operations on a container body (e.g., a D/I container body), and is particularly applicable to die necking. In the case of multiple necking operations in general, a first neck portion is formed using a first necking assembly to provide a first neck diameter on the open end of the container body. Often a temporary neck portion having a temporary neck diameter is initially formed with a necking assembly such that the first neck portion is actually a complete reformation of the temporary neck portion to achieve a first neck diameter which is less than the temporary neck diameter. This total reformation of the previously necked portion, commonly referred to as smooth die necking, may be repeated a number of times to achieve a desired end diameter with a single neck configuration and principles of the present invention apply to this smooth die necking operation. In addition, a second neck portion may be formed from only a mesial part of the first neck portion using a second necking assembly to provide a second neck diameter which is less than the first neck diameter and to thereby define a double neck container body configuration. Although principles of the present invention may be incorporated to produce a double neck container body configuration, it will be appreciated that they may be extended when further necking operations are incorporated as well (e.g., to produce a triple neck container body configuration).

One aspect of the present invention relates to venting during multiple necking operations generally of the above-described type. For instance, prior to/when performing necking operations on an already necked container body, the configuration of the corresponding necking assembly may be such that a substantially enclosed space is defined by an exterior surface of the container body and portions of the necking assembly. One such configuration is a necking die which not only incorporates a necking surface for further reducing the diameter of the end of the container body, but which also incorporates a supporting bore which engages the container body's sidewall prior to/during such necking operations (e.g., to provide a piloting feature to properly align the container body and necking assembly). As can be appreciated, this supporting bore does not actually have to be part of the necking assembly, but instead may be a separate structure positioned adjacent thereto.

By defining the above-described enclosed space during further necking operations on an already necked container body, air or other fluid may become trapped therein. In the case of die necking operations in which the container body is advanced relative to the particular necking die at relatively high speeds to maximize production capacity, the compression of the air or other fluids in this space may result in the application of hydraulic-type forces on the typically mechanically unsupported, inwardly tapering portion(s) of the container body. This may result in wrinkling or other types of metal deformation. In order to reduce the effects of and preferably eliminate the application of these hydraulic-type forces, the present invention provides for a venting of this enclosed space. Specifically with regard to venting in multiple die necking operations, at least one port may be incorporated on and extend through the necking die which is being used to further reduce the diameter of the already necked container body (e.g., via smooth die necking, forming multiple neck container body configurations). In this case, as the container body is advanced relative to the necking die air/fluid is forced out of the port(s) by progressive reduction of the size of the enclosed space.

Selection of various parameters relating to the venting port(s) may affect the extent of the benefits achieved by the present invention in relation to the above-noted hydraulic-type forces. For instance, a plurality of ports may be utilized to achieve a flow of air/fluid therethrough which reduces such forces to a desired degree. The plurality of ports may be substantially equally-spaced and annularly positioned about the necking die. Moreover, the positioning of the port(s) may impact the duration of the relief/reduction of the hydraulic-type forces. For instance, the port(s) may assume a variety of positions along the length of the above-identified supporting bore which engages the sidewall of the container body and still achieve venting for at least a portion of the necking operation. However, the port(s) may be positioned so as to remain open during a substantial portion of, and preferably for the duration of, the necking of the already necked container body. One such location is that portion of the supporting bore in proximity to where the necking die initially tapers inwardly toward its central axis.

Another aspect of the present invention relates to centering the container body during multiple necking operations generally of the above-described type. Initially, a temporary neck portion is formed with a necking assembly to provide a temporary neck diameter which is less than the sidewall diameter. Thereafter, a first neck portion is formed with a first necking assembly to provide a first neck diameter which is less than the temporary neck diameter. Prior to undergoing another necking operation to form a second neck portion, the container body is aligned with a second necking assembly. One assembly for achieving this alignment is to incorporate a support which engages the sidewall of the container body before the end of the container body engages the necking surface of the second necking assembly. This support may be provided by the above-described configuration of a necking die having a supporting bore in addition to the necking surface. Moreover, the leading portion of the necking die may have a rounded configuration to direct the container body within the supporting bore. Consequently, as the container body is axially advanced relative to the necking die the initial contact is with the sidewall of the container body to coaxially align such with the central axis of the necking die. Since there may be a trapping of air or other fluid by this type of engagement of the sidewall with the necking die in this necking operation, the above-described venting feature is preferably utilized in this aspect as well.

DETAILED DESCRIPTION

The present invention will be described with reference to the accompanying drawings which assist in illustrating the pertinent features thereof. In this regard, the present invention generally relates to performing multiple necking operations on an open end of a container body, such as a D&I container body. One type of multiple necking operation, namely multiple die necking, is disclosed in U.S. Pat. No. 4,403,493 which is assigned to the assignee of this application and the entire disclosure of which is hereby incorporated by reference. U.S. Pat. Nos. 3,687,098 and 4,513,595 disclose, inter alia, various ways in which container bodies may be transferred between and/or provided to multiple necking stations, and the entire disclosure of such patents is also incorporated by reference herein.

Figure 1:
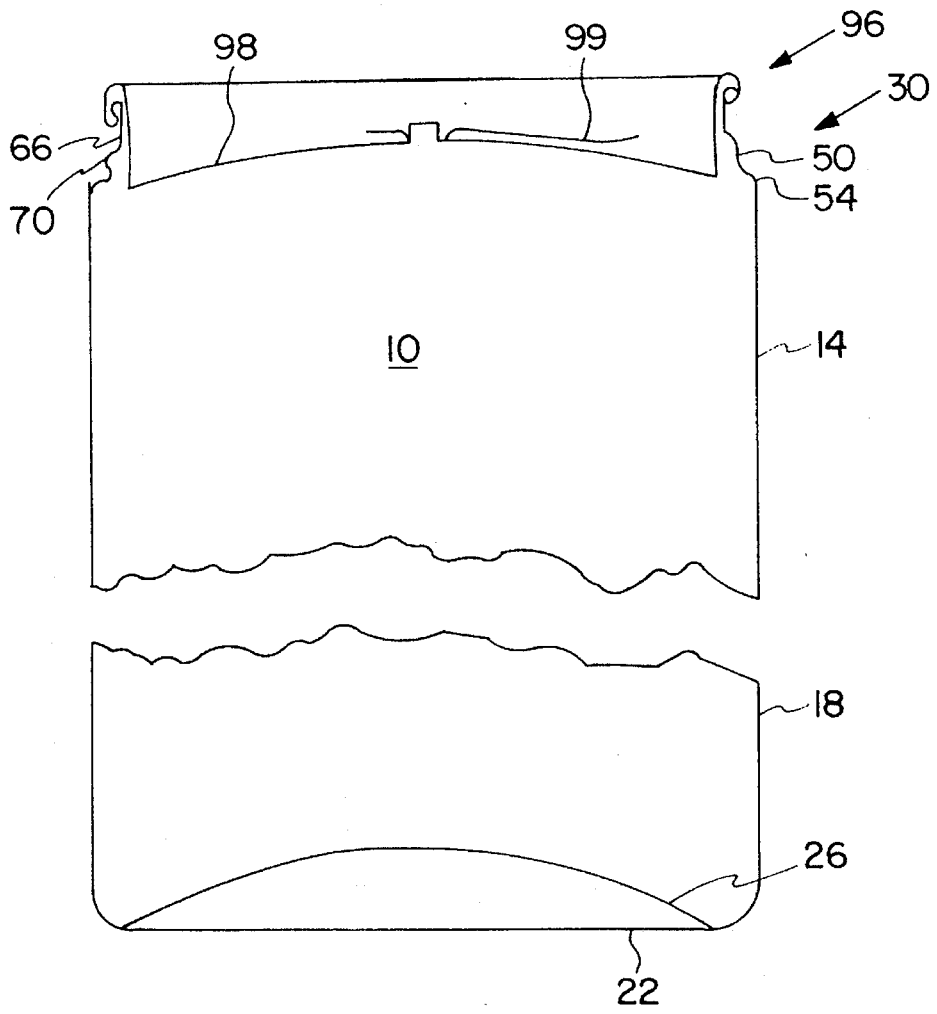
FIG. 1 is a cross-sectional view of a double-necked D&I can.
Figure 2A:
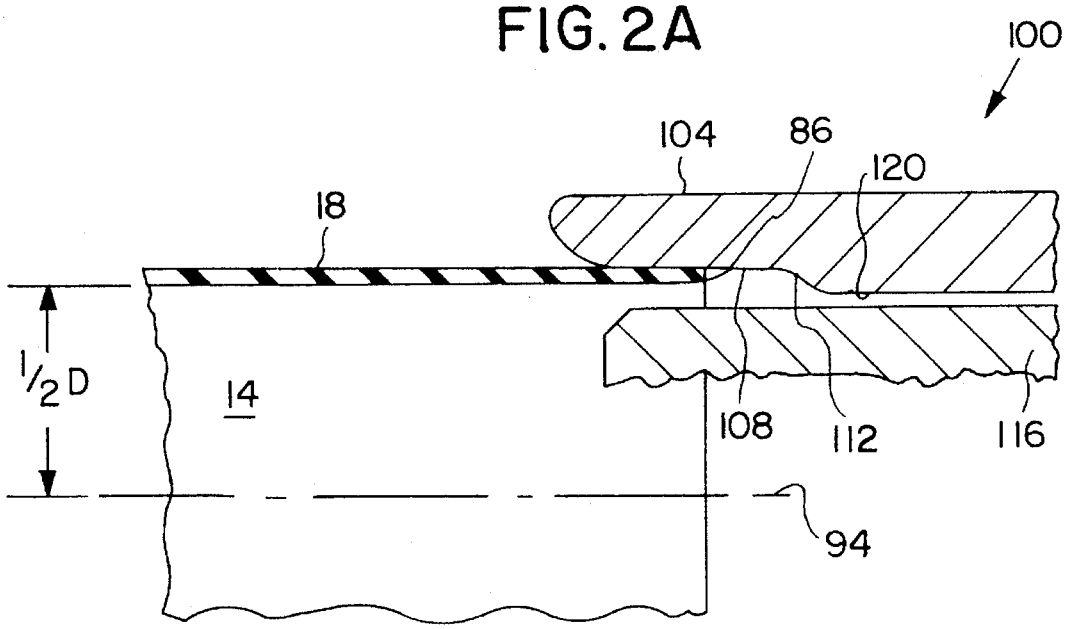
FIG. 2*a* is a cross-sectional view of a first stage die necking set and container body as the container body is being introduced thereto for the initial necking of the open end of the container body.
Figure 2B:
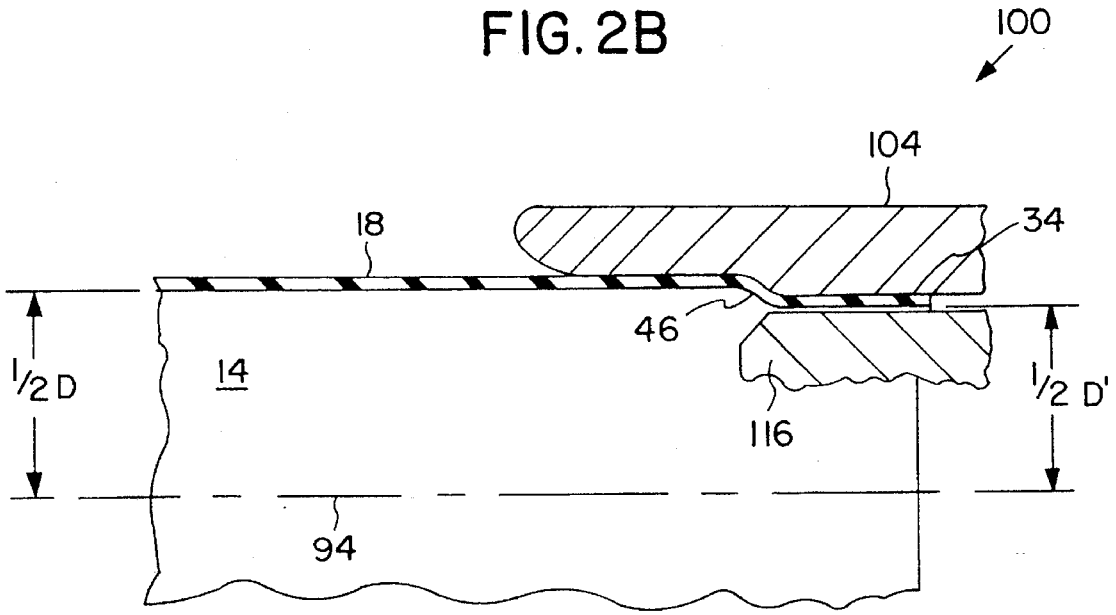
FIG. 2*b* is a cross-sectional view of the die necking set of FIG. 2*a* with a temporary neck portion of the container body being completely formed.

One configuration of a D&I can 10 is illustrated in Fig. 1. Generally, the D&I can 10 includes a container body 14 having a sidewall 18 and integrally formed bottom 22. The bottom 22 typically includes a generally concave dome 26 for strengthening the D&I can 10. A necked region 30 is formed on the upper portion of the sidewall 18 in a manner to be described below and includes a first neck portion 50 having a first neck diameter $D_1$ (FIG. 2*d*) which is less than the sidewall diameter D (FIG. 2*a*) and a second neck portion 66 having a second neck diameter $D_2$ (FIG. 3*b*) which is less than the first neck diameter $D_1$. Consequently, the container body 14 has a double-necked configuration. An end piece 98 is seamed onto the open end of the container body 14 at 96 to provide the D&I can 10 and such typically includes a pull-tab opener 99.

Figure 3A:
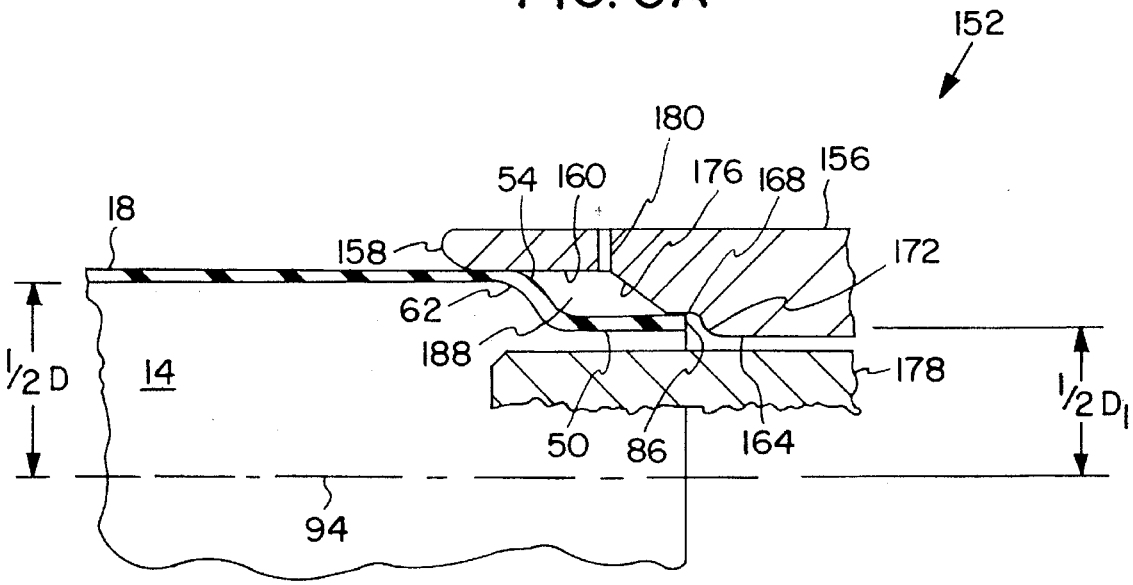
FIG. 3*a* is a cross-sectional view of a third stage die necking set as the container body is being introduced thereto for formation of a second neck portion.
Figure 3B:
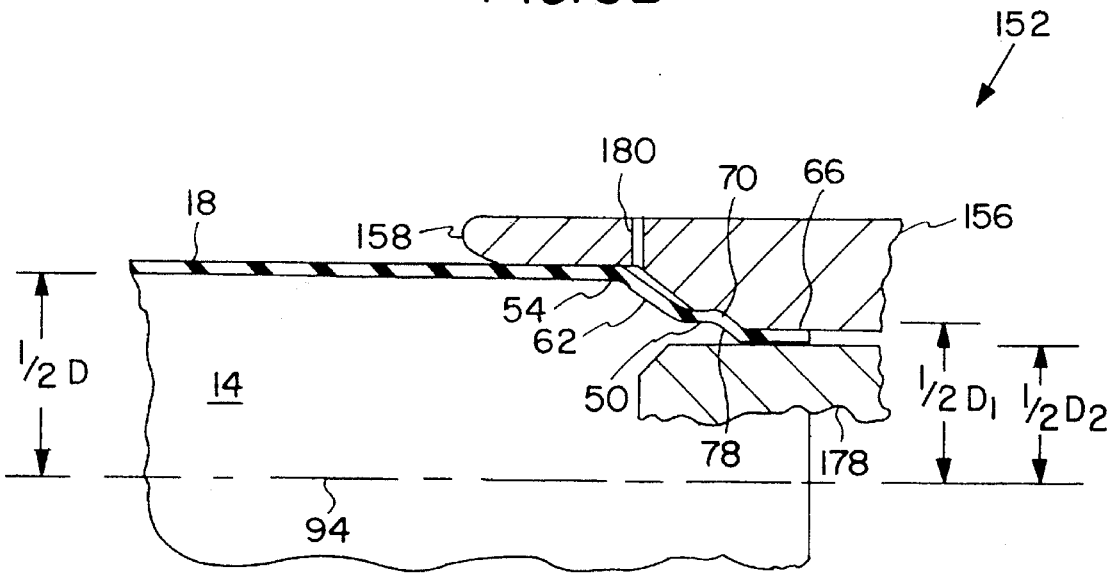
FIG. 3*b* is a cross-sectional view of the die necking set of FIG. 3*a* with the second neck portion of the container body being completely formed and with at least a portion of the first neck portion being retained to provide a double-necked container body configuration.
Figure 4:
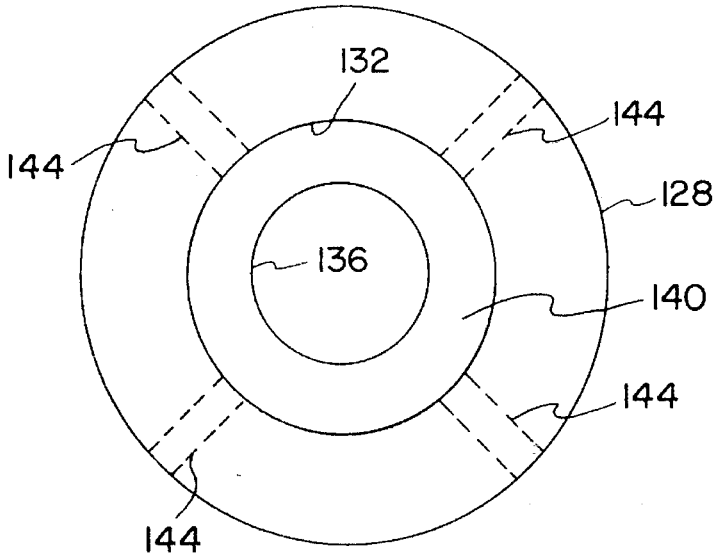
FIG. 4 is an end view of the die necking step of FIG. 2*c*.

Principles of the present invention are illustrated in FIGS. 2–4 and generally entails a plurality of necking stations for performing multiple necking operations on a container body, such as the container body 14. Referring initially to FIGS. 2*a*–2*b*, a first stage die necking set 100 includes a first stage necking die 104 and a first stage necking punch 116. The first stage necking die 104 includes a substantially cylindrically-shaped first stage supporting bore 108 that is substantially the same diameter as the sidewall diameter D of the container body 14 and is substantially parallel with the sidewall 18 when properly aligned therewith. The first stage necking die 104 also includes a substantially frustumly-shaped first stage necking surface 112 which directs the end 86 of the container body 14 inwardly toward the central axis 94 (of the container body 14 but which substantially coincides with the central axis of the various necking dies when properly aligned therewith) and a substantially cylindrically-shaped first stage necking bore 120 which thereafter redirects/assists in redirecting a mesial portion of the container body 14, typically such that it is substantially parallel with the sidewall 18, to define a temporary neck portion 34. In this regard, the first stage necking punch 116 is substantially cylindrical and concentrically positioned within the first stage necking die 104 such that it is spaced from the first stage necking bore 120 to allow entry of the noted mesial portion of the container body 14 therebetween.

In summary, the first necking operation generally includes axially advancing the container body 14 relative to the first stage necking die 104. More specifically, in one embodiment this is provided by engaging the bottom 22 of the container body 14 with a cam-actuated pusher pad (not shown) and advancing such toward a stationary first stage necking die 104. Moreover, in this embodiment forced air (not shown) is directed through a port (not shown) in the first stage necking punch 116 into the open end of the container body 14 and this air continues to be applied throughout the first necking operation.

During the relative axial advancement between the container body 14 and the first stage necking die 104, the sidewall 18 may and typically does engage the first stage supporting bore 108 of the first stage necking die 104. However, the orientation of the open end of the container body 14 is substantially unchanged until the end 86 of the container body 14 engages and is directed inwardly toward the axis 94 by the engagement of the end 86 against the first stage necking surface 112. The end 86 is thereafter redirected and forced between the first stage necking bore 120 of the first stage necking die 104 and the first stage necking punch 116, typically into an orientation which is substantially parallel to that of the sidewall 18. In one embodiment, the first stage necking punch 116 is cam-actuated (not shown) and moves between the positions illustrated in FIGS. 2*a* and 2*b*. In this case, the first stage necking punch 116 moves in the same direction as the container body 14 while undergoing the first necking operation (from the position of FIG. 2*a* to the position of FIG. 2*b*) and moves at substantially the same speed as the container body 14.

Based upon the foregoing, the first stage necking operation reforms a mesial portion of the container body 14 such that a temporary transition portion 46 extends inwardly from the sidewall 18 toward the central axis 94. A temporary neck portion 34 extends from an end of this temporary transition portion 46, typically in substantially parallel fashion with the sidewall 18, to form a temporary neck diameter D' which is less than the sidewall diameter D. After this temporary neck portion 34 is formed (FIG. 2*b*), the camactuated pusher pad (not shown) retracts away from the first stage necking die 104, the first stage necking punch 116 moves back to the position illustrated in FIG. 2*a*, forced air continues to be applied in the above-described manner, and the container body 14 is removed from the first stage die necking set 100.

Figure 2C:
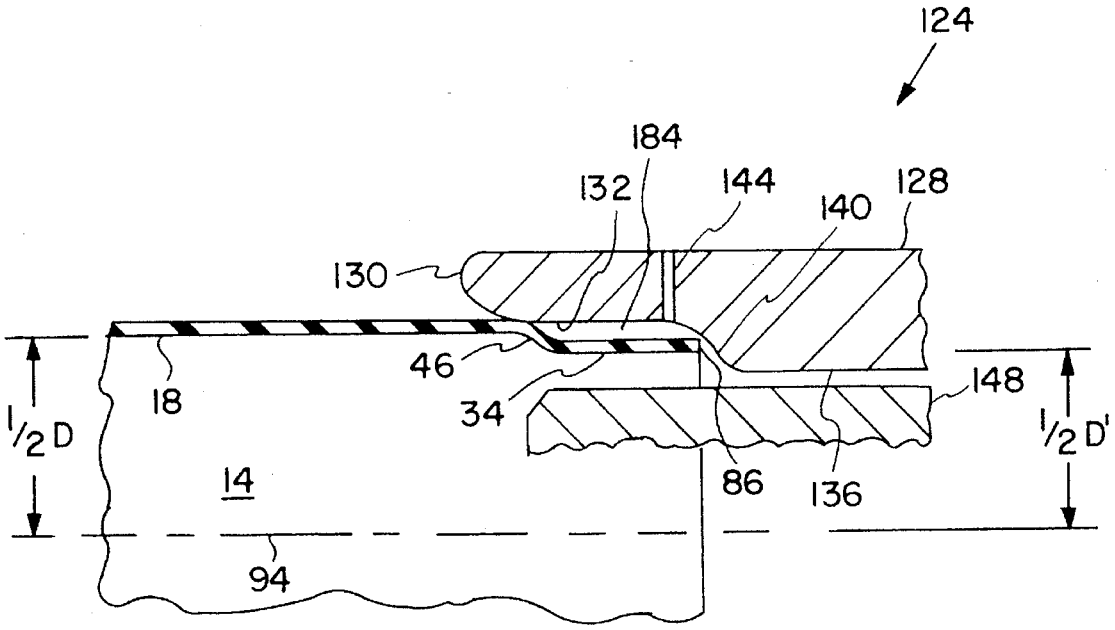
FIG. 2*c* is a cross-sectional view of a second stage die necking set which performs a smooth die necking operation as the container body is being introduced thereto by formation of a first neck portion from the entire temporary neck portion.
Figure 2D:
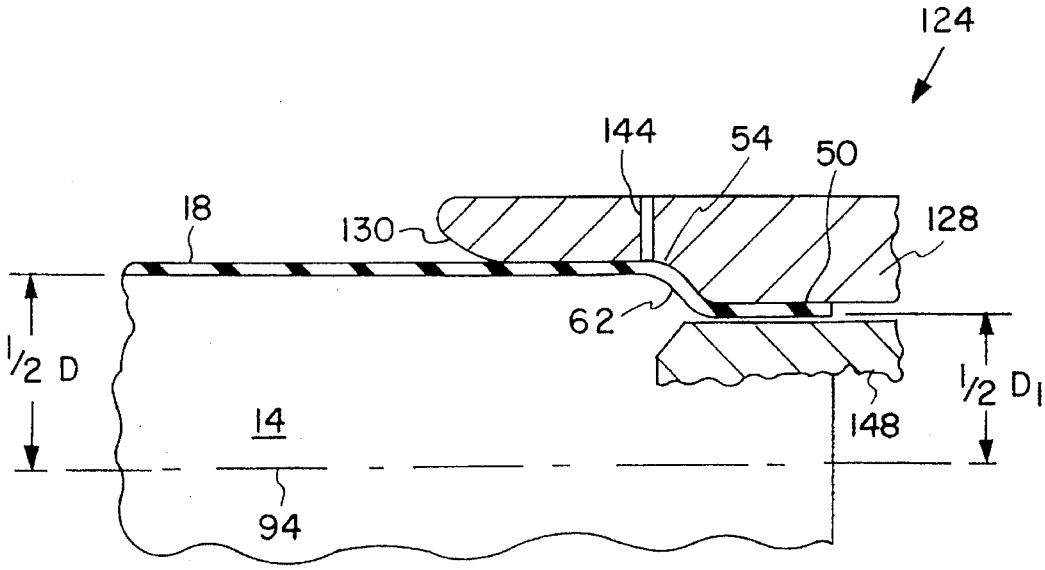
FIG. 2*d* is a cross-sectional view of the second stage die necking set of FIG. 2*c* with the first neck portion of the container body being formed by total reformation of the temporary neck portion.

Referring to FIGS. 2*c*–2*d*, a second stage die necking set 124 is illustrated therein. This particular second stage die necking set 124 performs one type of a smooth necking operation on the container body 14 (i.e., a total reformation of the temporary neck portion 34 into a first neck portion 50 having a smaller diameter $D_1$) and utilizes principles of the present invention. The second stage die necking set 124 includes a second stage necking die 128 and a second stage necking punch 148. The second stage necking die 128 includes a substantially cylindrically-shaped second stage supporting bore 132 that is substantially the same diameter as the sidewall diameter D and is substantially parallel with the sidewall 18 when properly aligned therewith. In this regard, the leading portion 130 of the second stage necking die 128 is rounded/convexly-shaped to direct the container body 14 within the second stage supporting bore 132.

The second stage necking die 128 also includes a substantially frustumly-shaped second stage necking surface 140 which directs the end 86 of the container body 14 further inwardly toward the central axis 94 and a substantially cylindrically-shaped second stage necking bore 136 which thereafter redirects/assists in redirecting a mesial portion of the container body 14, typically such that it is substantially parallel with the sidewall 18, to define a first neck portion 50. In this regard, the second stage necking punch 148 is substantially cylindrical and concentrically positioned within a portion of the second stage necking die 128 and is spaced from the second stage necking bore 136 to allow entry of the noted mesial portion of the container body 14 therebetween.

As illustrated in FIG. 2c, there is a substantially enclosed space 184 defined by the container body 14 and the second stage supporting bore 132 during the second necking operation, particularly when the sidewall 18 engages the second stage supporting bore 132 and after the end 86 of the container body 14 actually engages the second stage necking surface 140. In order to allow for a venting of all or at least a portion of any fluid in this space 184 (e.g., air), at least one port 144, and typically a plurality of ports 144, extend through the second stage necking die 128 as illustrated in FIG. 4. In this case, the plurality of ports 144 will typically be radially extending and substantially equallyspaced about an annular portion of the second stage necking die 128.

As the container body 14 is advanced relative to the second stage necking die 128 the size of the enclosed space 184 is progressively reduced which forces all or at least a portion of any trapped fluid out through the port(s) 144. Since the enclosed space 184 may exist for a substantial portion of the second necking operation, it may be desirable to position the port(s) 144 at a location on the second stage necking die 128 such that the port(s) 144 remain open during a substantial portion of, and preferably for the duration of, the second necking operation. Typically, this position will be proximate the second stage necking surface 140. However, it may be undesirable to position the port(s) 144 at a location which may result in engagement with the end 86 of the container body 14.

The number and size of the ports 144 may be selected to ensure that the flow of fluid therethrough will be adequate to reduce the potential for deformation of the container body 14 during multiple necking operations (e.g., multiple smooth die necking operations) to a desired degree, such as due to hydraulic-type forces being exerted on the mechanically unsupported portions of the container body 14 by the compression of fluid in the enclosed space 184. That is, the number and size of the ports 144 should accommodate for a desired flow rate of fluid therethrough. As an example, when the diameter of the second stage supporting bore 132 ranges from about 2.618 inches to about 2.622 inches with the temporary neck diameter D' ranging from about 2.522 inches to about 2.271 inches to define an initial volume for the enclosed space 184 ranging from about 0.238 $in.^3$ to about 0.800 $in.^3$ the number of ports 144 may range from about 8 to about 12, the diameter of each such port 144 may range from about 0.050 inches to about 0.070 inches, and the length of each such port 144 may range from about 0.199 inches to about 0.203 inches. As can be appreciated, in order to reduce the length of a given port 144, it may be radially extending from the central axis 94 and pass through the second stage necking die 128 substantially perpendicular thereto.

In summary, the second necking operation generally includes axially advancing the container body 14 relative to the second stage necking die 128. More specifically, in one embodiment this is provided by engaging the bottom 22 of the container body 14 with a cam actuated pusher pad (not shown) and advancing the container body 14 toward a stationary second stage necking die 128. Moreover, in this embodiment forced air (not shown) is directed through a port (not shown) in the second stage necking punch 148 into the open end of the container body 14 and this air continues to be applied throughout the second necking operation. Consequently, the use of ports 144 is particularly desirable in this instance (e.g., the ports 144 provide a means for evacuating at least part of any of the forced air within space 184).

During the relative axial advancement between the container body 14 and the second stage necking die 128, the sidewall 18 of the container body 14 may engage the leading portion 130 of the second stage necking die 128 to direct the container body 14 within the second stage supporting bore 132 before the end 86 of the container body 14 actually engages the second stage necking surface 140. Nonetheless, when the end 86 engages the second stage necking surface 140 and with the sidewall 18 engaging the second stage supporting bore 132, the enclosed space 184 is defined and any fluid therein is effectively trapped. However, as the container body 14 is advanced relative to the second stage necking die 128, all or at least a portion of any such trapped fluid is forced out through the port(s) 144 by the progressive reduction of the size of the space 184.

After the initial engagement of the end 86 of the container body 14 with the second stage necking surface 140, the end 86 is also directed further inwardly toward the central axis 94. Once again, all or any portion of any fluid in the enclosed space 184 continues to be forced out through the port(s) 144 by the progressive reduction of the size of the enclosed space 184. The end 86 is thereafter redirected and forced between the second stage necking bore 136 of the second stage necking die 128 and the second stage necking punch 148, typically into an orientation which is substantially parallel to that of the sidewall 18. In one embodiment, the second stage necking punch 148 is cam-actuated (now shown) and moves between the positions illustrated in FIGS. 2*c* and 2*d*. In this case, the second stage necking punch 148 moves in the same direction as the container body 14 while undergoing the second necking operation (from the position of FIG. 2*c* to the position of FIG. 2*d*) and moves at substantially the same speed as the container body 14.

As illustrated in FIG. 2*d*, the second stage necking operation totally reforms the temporary neck portion 34 and temporary transition portion 46 to define a first transition portion 62 which extends inwardly from a first shoulder 54 on the sidewall 18 toward the central axis 94 and a first neck portion 50 which extends from an end of the first transition portion 62, typically in substantially parallel fashion with the sidewall 18, to form a first neck diameter $D_1$ which is less than that of both the sidewall diameter D and temporary neck diameter D'. This total reformation of the temporary neck portion 34 allows for a desirable reduction in the diameter of the open end of the container body 14 while minimizing any reduction in the volume of the container body 14. After this first neck portion 50 is formed (FIG. 2*d*), the cam-actuated pusher pad (not shown) retracts away from the second stage necking die 128, the second stage necking punch 148 moves back to the position illustrated in FIG. 2*c*, forced air continues to be applied in the above-described manner, and the container body 14 is removed from the second stage die necking set 124.

The above-described second necking operation may be performed multiple times to achieve a final, single neck container body configuration. That is, the above-described smooth die necking operation may be repeated a number of times by using necking dies of progressively reduced diameter. In each case, it would be desirable to incorporate vents in these necking dies, as described above, to vent all or at least a portion of the fluid in the above-defined enclosed space in accordance with principles of the present invention.

Referring to FIGS. 3*a*–3*b*, a third stage die necking set 152 is illustrated therein which provides a double neck container body configuration and which may utilize principles of the present invention. The set 152 includes a third stage necking die 156 and a third stage necking punch 178. The third stage necking die 156 includes a substantially cylindrically-shaped third stage sidewall supporting bore 160 that is substantially the same diameter as the sidewall diameter D and is substantially parallel with the sidewall 18 when properly aligned therewith. In this regard, the leading portion 158 of the third stage necking die 156 is rounded/convexly-shaped to direct the container body 14 within the third stage sidewall supporting bore 160. The third stage necking die 152 also includes a substantially frustumly-shaped tapered surface 176 which extends inwardly toward the central axis 94; a substantially cylindrically-shaped third stage neck supporting bore 168 which extends from an end of the tapered surface 176, typically in substantially parallel fashion with the sidewall 18 and which may initially engage and support at least part of the first neck portion 50; a substantially frustumly-shaped third stage necking surface 172 which directs the end 86 of the container body 14 further inwardly toward the central axis 94; and a substantially cylindrically-shaped third stage necking bore 164 which directs/assists in redirecting the end 86, typically to be substantially parallel with the sidewall 18, to define the second neck portion 66. In this regard, the third stage necking punch 178 is substantially cylindrical and concentrically positioned within a portion of the third stage necking die 156 and is spaced from the third stage necking bore 164 to allow entry of a mesial portion of the container body 14 therebetween.

As illustrated in FIG. 3a, there is a substantially enclosed space 188 defined by the container body 14, the third stage sidewall supporting bore 160, and the tapered surface 176 during the third necking operation (i.e., when the first neck portion 50 engages the third stage neck supporting bore 168 and/or when the end 86 engages the third stage necking surface 172). In order to allow for a venting of all or at least a portion of any fluid in this space 188 (e.g., air), at least one port 180 and, as noted above, typically a plurality of substantially equally-spaced, radially extending ports 180 are annularly positioned about and extend through the third stage necking die 156. As the container body 14 is advanced relative to the third stage necking die 156 the size of the enclosed space 188 is progressively reduced which forces all or at least a portion of the fluid out through the port(s) 180. Since the enclosed space 188 may exist for a substantial portion of the third necking operation, it may be again desirable to position the port(s) 180 at a location on the third stage necking die 156 such that the port(s) 180 remain open during a substantial portion of, and preferably for the duration of, the third necking operation. Typically, this position will be on the end of the third stage sidewall supporting bore 160 proximate the tapered surface 176. However, as noted above, it may be undesirable for the end 86 of the container body 14 to engage any of such ports 180 during necking operations.

As noted above, the number and size of the ports 180 should be selected to ensure that the flow of fluid through such ports 180 will be adequate to reduce the potential for deformation of the container body 14 during multiple necking operations to a desired degree. That is, the number and size of the ports 180 should accommodate for a desired flow rate of fluid therethrough. As an example, when the diameter of the third stage sidewall supporting bore 160 ranges from about 2.618 inches to about 2.622 inches and the diameter of the third stage neck supporting bore 168 ranges from about 2.4600 inches to about 2.4602 inches to define an initial volume for the enclosed space 188 ranging from about 0.305 in.$^3$ to about 0.315 in.$^3$ the number of ports 180 may range from about 8 to about 12, the diameter of each such port 180 may range from about 0.050 inches to about 0.070 inches, and the length of each such port 180 may range from about 0.199 inches to about 0.203 inches when such ports 180 are radially extending.

In summary, the third necking operation generally includes axially advancing the container body 14 relative to the third stage necking die 156. More specifically, in one embodiment this is provided by engaging the bottom 22 of the container body 14 with a cam-actuated pusher pad (not shown) and advancing the container body 14 toward a stationary third stage necking die 156. Moreover, in this embodiment forced air (not shown) is directed through a port (not shown) in the third stage necking punch 178 into the open end of the container body 14 and this air continues to be applied throughout the third necking operation. Consequently, the use of ports 180 is particularly desirable in this instance (e.g., the ports 180 provide a means for evacuating at least part of any of the forced air within space 188).

During the relative axial advancement between the container body 14 and the third stage die necking set 152, the leading portion 158 of the third stage necking die 160 may engage the container body 14, typically the sidewall 18, and therefore direct the container body 14 within the third stage sidewall supporting bore 160 before the end 86 of the container body 14 engages the third stage necking surface 172. Consequently, prior to beginning the third necking operation, the container body 14 is nested and piloted (i.e., concentrically aligned) with the third stage necking die 156. The first neck portion 50 may also initially engage and be supported by the third stage neck supporting bore 168 as the container body 14 is axially advanced and before the third necking operation actually begins. When the sidewall 18 and first neck portion 50 establish contact with the third stage necking die 156, the enclosed space 188 is effectively defined and fluid therein is effectively trapped. However, as the container body 14 is advanced relative to the third stage necking die 156, all or at least a portion of any such trapped fluid is forced out through the port(s) 180 by the progressive reduction of the size of the space 188.

After the initial engagement of the end 86 of the container body 14 with the third stage necking surface 172, the end 86 is directed further inwardly toward the central axis 94. Moreover, all or at least a portion of any fluid within the enclosed space 188 continues to be forced out through the port(s) 180 by the progressive reduction in size of the space 188 by the advancement of the container body 14 relative to the third stage necking die 156. The end 86 is thereafter redirected and forced between the third stage necking bore 164 and of the third stage necking punch 178 as illustrated in FIG. 3*b*, typically into an orientation which is substantially parallel to that of the sidewall 18. In one embodiment, the third stage necking punch 178 is cam-actuated (not shown) and moves between the positions illustrated in FIGS. 3*a* and 3*b*. In this case, the third stage necking punch 178 moves in the same direction as the container body 14 while undergoing the third necking operation (from the position of FIG. 3*a* to the position of FIG. 3*b*) and moves at substantially the same speed as the container body 14.

Upon completion of the third necking operation, the container body 14 has a double-necked configuration since part of the first neck portion 50 is retained after the third necking operation. That is, the first transition portion 62 extends inwardly from the first shoulder 54 on the sidewall 18 toward the central axis 94. Portions of the first neck portion 50 remaining after the third necking operation extend substantially parallel with the sidewall 18 and such defines a first neck diameter $D_1$. The second shoulder 70 is positioned on the remaining mesial end of the first neck portion 50 and the second transition portion 78 extends inwardly therefrom toward the central axis 94. The second neck portion 66 extends from the end of the second transition portion 78 substantially parallel to the sidewall 18 and defines a second neck diameter $D_2$. Consequently, the first and second shoulders 54, 70 define the double-neck container body configuration. After the second neck portion 66 is formed, the cam-actuated pusher pad (not shown) retracts away from the third stage necking die 128, the third stage necking punch 178 moves back to the position illustrated in FIG. 3*a*, forced air continues to be applied in the above-described manner, and the container body 14 is removed from the third stage die necking set 152.

Although the container body 14 may be sealed when in the above-described double-necked configuration, in some current techniques the container body is subjected to further processing to have a continuous transition portion from the sidewall to the end neck portion. As is known in the art this process is called smooth necking and one process for smooth necking utilizes spin-flow forming. Moreover, although only a double neck container body configuration is illustrated and discussed herein, it can be appreciated that the principles of the present invention may be extended to additional necking operations (e.g., those which produce a triple or quad neck container body configuration). Furthermore, as discussed above, principles of the present invention may be applied to multiple smooth necking operations as well.

As an example of the type of reductions which are possible utilizing the multiple die necking operations of the present invention, the diameter of a container body having a sidewall thickness ranging from about 0.0060 inches to about 0.0064 inches may be reduced from a sidewall diameter D of about 2.600 inches to a final neck diameter of about 2.157 inches using multiple smooth necking operations (e.g., an initial die necking procedure and 9 subsequent smooth die necking procedures) using principles of the present invention. In utilizing the above-described three stage necking operation of FIGS. 2*a*–2*b*,2*c*–2*d* and 3*a*–3*b* to produce a double necked container body configuration, the first necking operation may produce a temporary neck diameter D' of about 2.509 inches, the second necking operation may produce a first neck diameter $D_1$ of about 2.456 inches, and the third necking operation may produce a second neck diameter $D_2$ of about 2.374 inches.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiment described hereinabove is further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A method for performing multiple necking operations on an upper and open end of a sidewall of a container body having an initial diameter, comprising the steps of:

forming a first neck portion having a first neck diameter less than the initial diameter on the upper end of the container body with a first necking assembly, said forming a first neck portion step comprising exerting a radially inwardly directed force on the upper end of the container body;

forming a second neck portion having a second neck diameter less than the first neck diameter on at least a mesial portion of the first neck portion with a second necking assembly, said forming a second neck portion step comprising exerting a radially inwardly directed force on the at least a mesial portion of the first neck portion;

capturing a fluid in a substantially enclosed area defined by an exterior portion of a portion of the sidewall of the container body and at least part of said second necking assembly disposed radially outwardly from said container body during at least a portion of said forming a second neck portion step, said capturing step comprising causing a potential for exerting a radially inwardly directed hydraulic force on portions of the container body which are radially and mechanically unsupported and which define a portion of said enclosed space; and venting the enclosed area during said forming a second neck portion step to reduce an amount of said hydraulic force and a potential for undesired deformation of the portions of the container body which are radially and mechanically unsupported and which define a portion of said enclosed space.

2. A method, as claimed in claim 1, wherein:

said forming a first neck portion step comprises axially advancing the container body relative to at least a portion of a first die necking assembly comprising said first necking assembly, wherein said first die necking assembly comprises an outer necking die which is circumferentially disposed about at least a portion of the container body, and wherein the enclosed area is formed by said axially advancing step which disposes the container body within said outer necking die of said first die necking assembly, said enclosed area being defined by a space between portions of said outer necking die and the container body.

3. A method, as claimed in claim 1, wherein:

said forming a first neck portion step comprises forming a first transition portion which extends inwardly from the sidewall of the container body toward a central axis of the container body, the first neck portion extending from an end of the first transition portion substantially parallel with the sidewall.

4. A method, as claimed in claim 3, wherein:

said forming a second neck portion step comprises retaining at least part of said first transition portion and the first neck portion and forming a second transition portion which extends from an end of the retained part of the first neck portion inwardly toward the central axis, and wherein the second neck portion extends from an end of the second transition portion substantially parallel with the sidewall.

5. A method, as claimed in claim 3, wherein:

said forming a second neck portion step comprises forming a second transition portion which extends from the sidewall inwardly toward the central axis and wherein the second neck portion extends from an end of the second transition portion substantially parallel with the sidewall, the second transition portion and the second neck portion totally replacing the first transition portion and the first neck portion.

6. A method, as claimed in claim 1, wherein:

said forming a second neck portion step comprises axially advancing the container body relative to at least a portion of a second die necking assembly comprising said second necking assembly, wherein second die necking assembly comprises an outer necking die which is circumferentially disposed about at least a portion of the container body, and wherein the enclosed area is formed by said axially advancing step which disposes the container body within said outer necking die of said second die necking assembly, said enclosed area being defined by a space between portions of said outer necking die and the container body.

7. A method, as claimed in claim 1, wherein:

said venting step comprises progressively reducing a size of the enclosed area.

8. A method, as claimed in claim 1, wherein:

said venting step is performed during at least a substantial portion of said forming a second neck portion step.

9. A method, as claimed in claim 1, wherein:

said substantially enclosed area is defined by engaging a portion of the sidewall with a substantially cylindrically-shaped supporting bore of said second necking assembly which is substantially parallel with the sidewall and disposed radially outwardly therefrom, and engaging an end of the container body against a substantially frustumly-shaped necking surface of said second necking assembly, said frustumly-shaped necking surface further forcing the upper end of the container body radially inwardly when the container body is disposed within said second necking assembly.

10. A method, as claimed in claim 1, further comprising the steps of:

forming a temporary neck portion having a temporary neck diameter less than initial diameter prior to said forming a first neck portion step, wherein said forming a first neck portion step comprises totally reforming the temporary neck portion and wherein the first neck diameter is less than the temporary neck diameter; and centering the container body relative to said second necking assembly prior to said forming a second neck portion step, wherein the second neck portion is formed from only part of the first neck portion to provide a double neck container body configuration.

11. A method, as claimed in claim 10, wherein:

said centering step comprises axially advancing the container body relative to at least a portion of said second necking assembly and engaging a portion of the container body with a rounded leading portion of said second necking assembly to direct the container body within a substantially cylindrically-shaped supporting bore of said second necking assembly which has a diameter substantially equal to the initial diameter of the sidewall.

12. A method, as claimed in claim 11, wherein:

said substantially enclosed area is defined by an engagement of the sidewall with said supporting bore of said second necking assembly and engaging an end portion of the container body against another part of said second necking assembly.

13. A method, as claimed in claim 1, wherein:

said forming a first neck portion step comprises axially advancing the container body relative to at least a portion of a first die necking assembly comprising said first necking assembly to position the container body within said first die necking assembly, said first die necking assembly comprising a first necking die disposed radially outwardly from the container body and a first punch concentrically positioned within and spaced from said first necking die, the first neck portion being formed by being forced radially inwardly between said first necking die and said first punch;

said forming a second neck portion step comprises axially advancing the container body relative to at least a portion of a second die necking assembly comprising said second necking assembly to position the container body within said second die necking assembly, said second die necking assembly comprising a second necking die disposed radially outwardly from the container body and a second punch concentrically positioned within and spaced from said second necking die, the second neck portion being formed by being forced radially inwardly between said second necking die and said second punch; and said venting step comprises progressively reducing a size of the enclosed area by said axially advancing step of said forming a second neck portion step.

14. A method, as claimed in claim 1, wherein:

said forming first and second neck portions steps each comprise axially advancing the container body relative to said first and second necking assemblies, respectively, said venting step comprises venting at a plurality of circumferentially spaced locations about the container body.

15. An apparatus for necking an upper and open end of a sidewall of a container body, said container body having a substantially cylindrical sidewall defining a sidewall diameter, a first transition portion extending from said sidewall inwardly toward a central axis of said container body, and a first neck portion extending from a mesial end of said first transition portion substantially parallel with said sidewall and defining a first neck diameter less than said sidewall diameter, said apparatus comprising:

a necking die having inner and outer surfaces and at least one port interconnecting said inner and outer surfaces, said inner surface comprising a substantially cylindrical sidewall supporting bore having a diameter substantially equal to said sidewall diameter and being substantially parallel with said sidewall, a substantially frustumly-shaped necking surface on an end of said sidewall supporting bore which extends inwardly toward a central axis of said necking die for exerting a radially inwardly directed force on said upper end of said container body, and a substantially cylindrical necking bore extending from an end of said necking surface defining a second neck diameter less than said first neck diameter and being substantially parallel with said sidewall;

a substantially cylindrical punch substantially concentrically positioned within and spaced from at least said necking bore; and means for axially advancing said container body relative to and within said necking die, wherein at least part of said first neck portion is forced inwardly toward said central axis of said container body by said necking surface and is forced between said punch and said necking bore to form a second neck portion having a second neck diameter less than said first neck diameter, wherein a fluid is captured in a substantially enclosed space defined by at least an engagement between said sidewall supporting bore of said necking die and exterior portions of said sidewall of said container body disposed radially inward therefrom and including said first neck portion prior to passing between said punch and said necking bore, said fluid having a potential for exerting a radially inwardly directed hydraulic force on portions of said container body which are radially and mechanically unsupported and which define a portion of said enclosed space, wherein said at least one port vents said enclosed space to reduce an amount of said hydraulic force and a potential for undesired deformation of said portion of said container body which is radially and mechanically unsupported and which defines a portion of said enclosed space.

16. An apparatus, as claimed in claim 15, wherein:

said at least one port is positioned substantially adjacent to an interconnection of said sidewall supporting bore and a tapered surface of said necking die which extends inwardly from said sidewall supporting bore toward said central axis.

17. An apparatus, as claimed in claim 16, wherein:

said tapered surfaces comprises said necking surface.

18. An apparatus, as claimed in claim 15, wherein said inner surface of said necking die further comprises:

a substantially frustumly-shaped surface which extends inwardly toward said central axis from an end of said sidewall supporting bore, said at least one port being positioned at an interconnection between said sidewall supporting bore and said tapered surface; and a substantially cylindrical neck supporting bore having a diameter substantially equal to said first neck diameter and being substantially parallel with said first neck portion, said neck supporting bore interconnecting said tapered surface and said necking surface.

19. An apparatus, as claimed in claim 15, wherein:

said at least one port is positioned on and extends through said sidewall supporting bore.

20. An apparatus, as claimed in claim 15, wherein:

a plurality of said ports are substantially equally and circumferentially spaced about said necking die and thereby circumferentially about said container body.

21. An apparatus, as claimed in claim 15, wherein:

a plurality of said ports are substantially radially extending relative to said central axis.

* * * * *